US006971903B2

(12) United States Patent
Goto et al.

(10) Patent No.: US 6,971,903 B2
(45) Date of Patent: Dec. 6, 2005

(54) PRESS-CONTACT CONNECTOR BUILT IN SUBSTRATE

(75) Inventors: Akira Goto, Aichi (JP); Yoshikazu Takagi, Aichi (JP); Kazushi Miyahara, Aichi (JP); Megumi Chiyoda, Aichi (JP)

(73) Assignee: J.S.T.Mfg. Co.,Ltd., Osaka (JP)

( * ) Notice: Subject to any disclaimer, the term of this patent is extended or adjusted under 35 U.S.C. 154(b) by 0 days.

(21) Appl. No.: 10/502,008

(22) PCT Filed: Nov. 21, 2003

(86) PCT No.: PCT/JP03/14898

§ 371 (c)(1),
(2), (4) Date: Jul. 20, 2004

(87) PCT Pub. No.: WO2004/049512

PCT Pub. Date: Jun. 10, 2004

(65) Prior Publication Data

US 2005/0106927 A1 May 19, 2005

(30) Foreign Application Priority Data

Nov. 22, 2002 (JP) ..... 2002-339688
Nov. 22, 2002 (JP) ..... 2002-339689

(51) Int. Cl.[7] ..... H01R 4/24
(52) U.S. Cl. ..... 439/404
(58) Field of Search ..... 439/395, 397, 439/399, 404, 405, 417

(56) References Cited

U.S. PATENT DOCUMENTS 3,444,506 A * 5/1969 Wedekind ..... 439/405
5,902,146 A * 5/1999 Hanami ..... 439/405
6,832,930 B2 * 12/2004 Kubota et al. ..... 439/404
6,835,089 B2 * 12/2004 Hayes et al. ..... 439/404
6,837,737 B2 * 1/2005 Baier et al. ..... 439/402
6,840,792 B1 * 1/2005 Kuan ..... 439/404
6,890,210 B2 * 5/2005 Lee ..... 439/404

FOREIGN PATENT DOCUMENTS

JP 51-84084 7/1976
JP 60-211784 10/1985
JP 2-44457 11/1990
JP 6-86261 12/1994

(Continued)

*Primary Examiner*—Khiem Nguyen
(74) *Attorney, Agent, or Firm*—Oblon, Spivak, McClelland, Maier & Neustadt, P.C.

(57) ABSTRACT

The insulation displacement terminal 3 is retained on the terminal retainer portion 5 of the main housing 6. The lead 12 of the insulation displacement terminal 3 is soldered to the first surface 10*a* of the circuit board 10 through the bottom plate 13 of the main housing 6 and the circuit board 10, which is held in the second retaining space 11 between the main housing 6 and second cover housing 8. After the insulation displacement terminal 3 in such a subassembly state is connected by insulation displacement with a desired portion of the insulated wire 2, the first cover housing 7 is combined with the main housing 6. The receiving portion 44 of the second cover housing 8 receives the insulation displacement load via the bottom plate 13 of the main housing 6 and the circuit board 10. This enables the inadvertent bending of the bottom plate 13 and circuit board 10 to be prevented, the reliable insulation displacement connecting of the connector with the insulated wire to be attained, and the so-called in-housing insulation displacement connecting of the connector with the insulated wire to be substantially carried out.

11 Claims, 12 Drawing Sheets

FOREIGN PATENT DOCUMENTS

| | | |
|---|---|---|
| JP | 9-261821 | 10/1997 |
| JP | 11-354191 | 12/1999 |
| JP | 2000-285994 | 10/2000 |
| JP | 2001-297817 | 10/2001 |
| JP | 2001-327038 | 11/2001 |
| JP | 2002-67789 | 3/2002 |

* cited by examiner

PRESS-CONTACT CONNECTOR BUILT IN SUBSTRATE

TECHNICAL FIELD

The present invention relates to an insulation displacement connector with a built-in board, containing a circuit board therein and connectable with electric wires by insulation displacement.

BACKGROUND ART

In a related art electric connector, there are techniques for connecting an insulation displacement terminal held in a connector housing with electric wire by insulation displacement (refer to, for example, JP-U-06-086261 and JP-A-2000-285994).

Further, an electric connector containing a circuit board has also been provided (refer to, for example, JP-A-2001-297817 and JP-A-2002-067789).

However, an electric connector containing a circuit board, wherein an insulation displacement terminal soldered to the circuit board is connected by insulation displacement with an electric wire within a connector housing, has not ever been provided.

The reasons for this reside in the following. When the terminal is connected by insulation displacement with the electric wire within the connector housing, there is a fear that the connector housing is bent due to an insulation displacement load imparted to the terminal, and that a portion where the terminal is soldered to the circuit board is broken due to the load.

In recent years, the connecting of various kinds of ECU (Electric Control Units) together by a network has been forwarded in a vehicle, such as an automobile.

For example, there is a case where a main ECU for governing an air-conditioner controlling operation and an ECU for governing a control operation for an angle of a louver of a duct of an air-conditioner are electrically connected together via a common feed wire.

In such a case, it is conceived that the insulation displacement terminal is connected by insulation displacement with the portion of a feed wire which is between ECU's, by using a connector containing therein the terminal and a circuit board to which the terminal is soldered.

Since a wiring distance between the two ECU's is various, it is preferable that the connecting by insulation displacement of the insulation displacement terminals with the electric wires be done in a final step of the connector assembling work.

However, when a drawing force is exerted from the outside on insulated wires, there is a fear that the connecting force of the insulation displacement terminals is lessened. In addition, since the insulation displacement terminals soldered to the circuit board in advance come to be connected by insulation displacement with the electric wires, therefore, there is the possibility that the soldered portions are broken when the terminals are connected by insulation displacement with the electric wires, or when a drawing load is imparted to the terminals.

DISCLOSURE OF THE INVENTION

The present invention has been made in view of these problems, and it is an object of the present invention to provide an insulation displacement connector with a built-in board in which the connecting force by insulation displacement of insulation displacement terminals is not lessened even when a drawing load is imparted from the outside to an insulated wire, and in which soldered portions of the insulation displacement terminals and circuit board are not influenced by such a drawing load.

Further, it is another object of the present invention to provide an insulation displacement connector containing a circuit board in which connection of the insulation displacement terminals with electric wires by insulation displacement within a connector housing can be substantially carried out.

To attain these objects, the present invention provides an insulation displacement connector with a built-in board comprising: an insulation displacement terminal including a body having an insulation displacement blade connectable with an insulated wire at an intermediate portion of the insulated wire by insulation displacement, and a lead extending from the body; a main housing including a bottom plate having a hole through which the lead is inserted, and a terminal retainer portion formed on the bottom plate for retaining the body of the insulation displacement terminal; a circuit board, wherein the lead inserted through the hole of the bottom plate of the main housing is soldered to the circuit board; a first cover housing attached to the main housing, wherein a first retaining space for the insulation displacement terminal is defined between the main housing and the first cover housing; and a second cover housing attached to the main housing, wherein a second retaining space for the circuit board is defined between the main housing and the second cover housing, wherein the insulated wire has a pair of bent portions, formed by the first covering housing, at both sides of the body of the insulation displacement terminal.

According to this invention, even when the insulated wire connected by insulation displacement with the insulation displacement terminal in the first retaining space receives a drawing load from the outside, this drawing load does not have influence upon the insulation displacement connecting portions, so that the reliability of electrical connection can be greatly heightened.

Furthermore, in the insulation displacement connector with a built-in board, the pair of bent portions of the insulated wires include a crank-like bent portion formed by opposed portions of the main housing and first cover housing.

According to this invention, a drawing load can be reliably prevented from imparting to the portions of connecting by insulation displacement, at the crank-like bent portion.

Furthermore, in the insulation displacement connector with a built-in board, the opposed portions of the main housing and first cover housing include an end wall of the first cover housing, and the insulation displacement connector further comprises a means for connecting the end wall to the portion of the main housing which corresponds thereto.

According to this invention, even when a drawing load is exerted from the outside on the insulated wires, the floating of the end wall of the first cover housing from the main housing can be reliably prevented, and the imparting of the drawing load on the connecting portions can be more reliably prevented.

Furthermore, in the insulation displacement connector with a built-in board, the insulated wires are plural parallel-extending insulated wires, and the connecting means includes a projection which are provided on either one of the main housing and first cover housing, and which extends between the adjacent insulated wires; and a recess provided in the other of the main housing and first cover housing and engaged with the corresponding projection.

According to this invention, when the projections are engaged with the recesses through spaces among the insulated wires, the imparting of the drawing load to the insulation displacement connecting portions can be more reliably prevented.

Furthermore, An insulation displacement connector with a built-inboard, comprises: an insulation displacement terminal including a body having an insulation displacement blade connectable with an insulated wire at an intermediate portion of the insulated wire by insulation displacement, and a lead extending from the body; a main housing including a bottom plate having a hole through which the lead is inserted; and a terminal retainer portion formed on the bottom plate for retaining the body of the insulation displacement terminal; a circuit board, wherein the lead inserted through the hole of the bottom plate of the main housing is soldered to the circuit board; a first cover housing attached to the main housing, wherein a first retaining space for the insulation displacement terminal is defined between the main housing and the first cover housing; and a second cover housing attached to the main housing, wherein a second retaining space for the circuit board is defined between the main housing and the second cover housing, wherein the second cover housing has a portion for receiving an insulation displacement load of the insulation displacement terminal via the bottom plate and circuit board, wherein the portion is formed on a position opposed to the terminal retainer portion of the main housing.

According to this invention, the bodies of the insulation displacement terminals are retained on the terminal retainer portion of the main housing, and the leads of the insulation displacement terminals inserted through the bottom plate of the main housing are soldered to the circuit board on which circuit elements were mounted in advance. The second cover housing is then combined with the main housing, and the circuit board is retained in the second retaining space to form a subassembly. In such a subassembly structure, the insulation displacement terminals can be connected by insulation displacement with desired portions of the insulated wires as, for example, feed wires, so that the degree of freedom of the terminal connecting operation is high. This subassembly can be suitably used, especially, for wiring LAN (Local Area Network) between various kinds of ECU's of a vehicle, such as an automobile. After the insulation displacement terminals are connected by insulation displacement with the insulated wires, the first cover housing is combined with the main housing.

Moreover, since the receiving portion of the second cover housing can receive an insulation displacement load via the bottom plate of the main housing and the circuit board, the bottom plate and circuit board are not inadvertently bent but a reliable insulation displacement connecting operation can be attained. This substantially enables a so-called in-housing insulation displacement connecting operation of the insulation displacement connector with a built-in board to be attained.

Furthermore, in the insulation displacement connector with a built-in board, wherein the second cover housing includes a rib, and a box-like member wherein at least a part of the box-like member is formed by the rib, and the receiving portion is provided in the box-like portion.

According to this invention, receiving portion provided on the box-like member securely receives the insulation displacement load, whereby a reliable insulation displacement connecting operation of the connector can be attained.

Furthermore, in the insulation displacement connector with a built-in board, the bottom plate of the main housing includes a rib capable of holding the circuit board between the second cover housing and the rib of the second cover housing.

According to this invention, the insulation displacement load does not cause the circuit board to be inadvertently bent.

Furthermore, in the insulation displacement connector with a built-in board, wherein the lead includes a deformable portion capable of being elastically deformed by the insulation displacement load.

According to this invention, even when a load should be imparted to the leads during an insulation displacement connecting operation of the connector, the elastically deformable portions of the leads are deformed to enable the load to be absorbed therein, whereby an unnecessary load is not imparted to the soldered portions.

Furthermore, in the insulation displacement connector with a built-in board, the deformable portion includes a portion bent in the crank-like shape.

According to this invention, the leads of a simple construction can reliably absorb the insulation displacement load.

Figure 1:
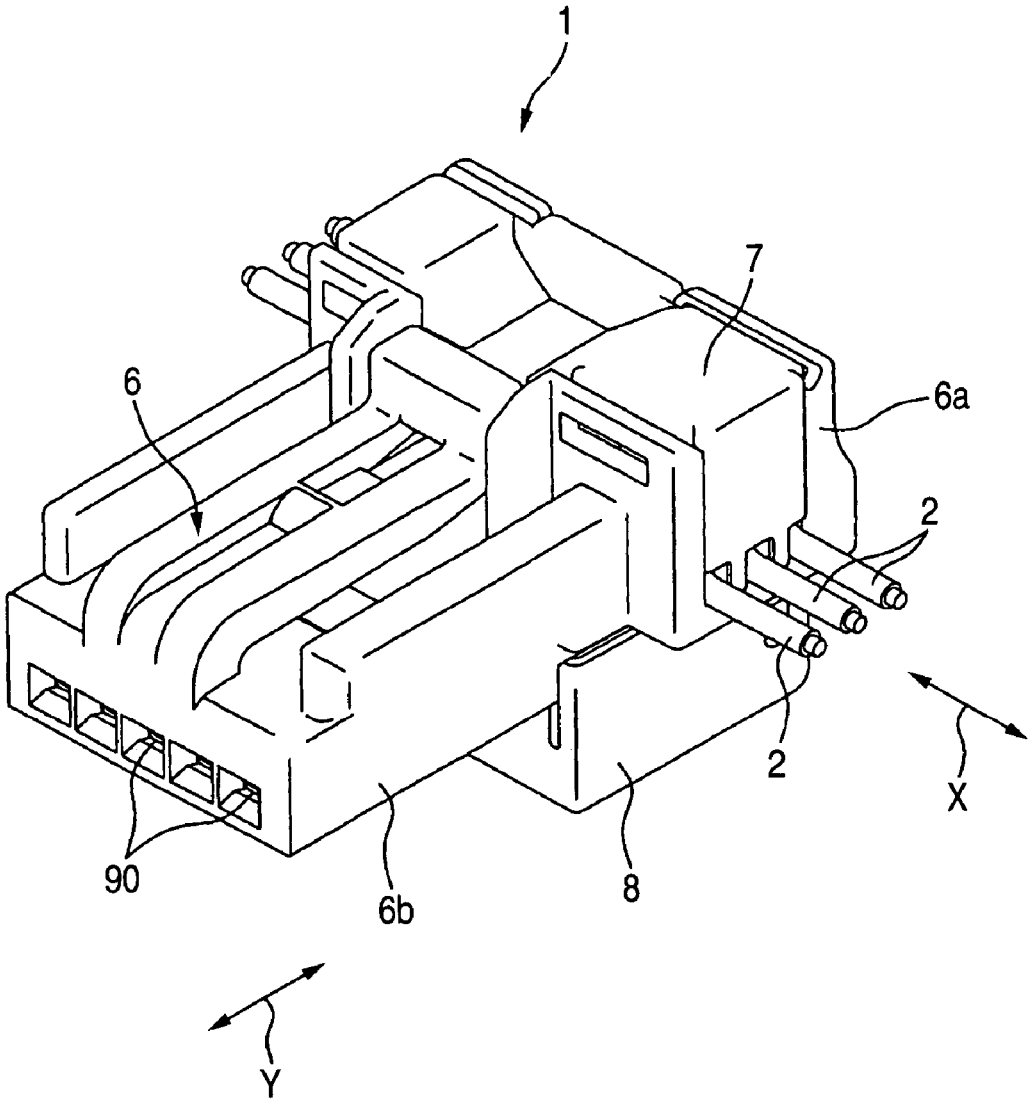
FIG. 1 is a schematic perspective view of a mode of embodiment of the insulation displacement connector with a built-in board according to the present invention.

Concerning the reference numerals and symbols in the drawings, 1 denotes an insulation displacement connector with a built-in board, 2 insulated wires, 3 insulation displacement terminals, 4 bodies, 5 terminal retainer portions, 6 a main housing, 7 a first cover housing, 8 a second cover housing, 9 a first retaining space, 10 a circuit board, 10*a* a first surface, 10*b* a second surface, 11 a second retaining space, 12 leads, 13 a bottom plate, 14 a through hole, 19 a first bent portion (portion bent in the shape of a crank), 20 a second bent portion, 21 a first wire retainer portion, 22 a second wire retainer portion, 23 a third wire retainer portion, 24 a recess, 25 a projection, 26 a recess, 26*a* a bottom wall, 27 an end wall, 41 and 42 ribs, 43 a box-like member, 44 a receiving section, 46 a rib, 67 a first projection, 68 a second projection (connecting means), 69 engagement holes (engagement portions, connecting means), 71 a first insulation displacement groove-forming member, 72 a second insulation displacement groove-forming member, 73 a insulation displacement groove, 74 an insulation displacement blade, 75 a connecting portion, 76 and 77 locking projections, 78 and 79 plate portions, 80 locking projections, 81 bendable members, R a retaining space, and B a bent portion (deformable portion).

BEST MODE FOR CARRYING OUT THE INVENTION

A preferred mode of embodiment of the present invention will be described with reference to the attached drawings.

Figure 2:
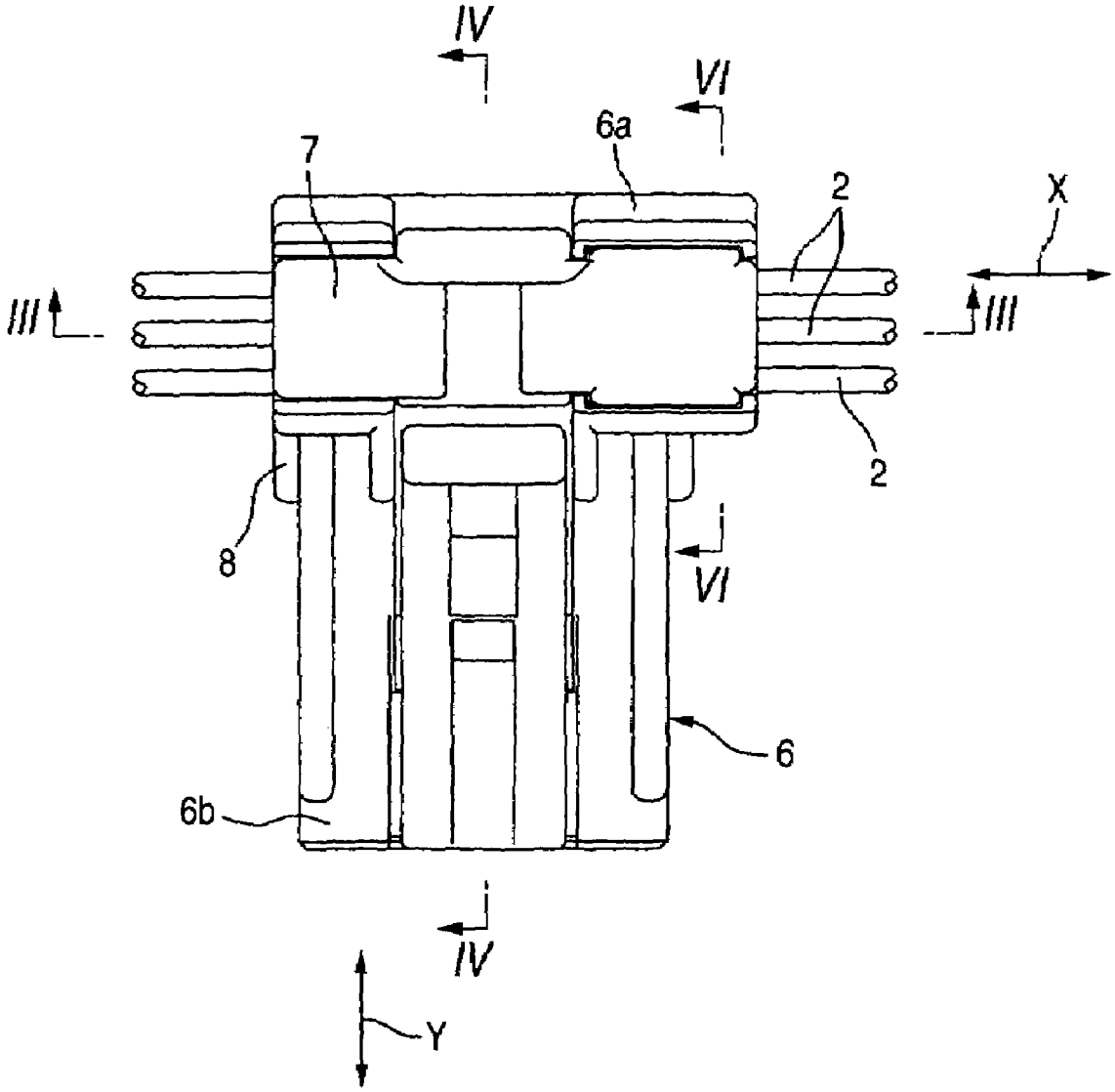
FIG. 2 is a plan view of the insulation displacement connector with a built-in board.
Figure 3:
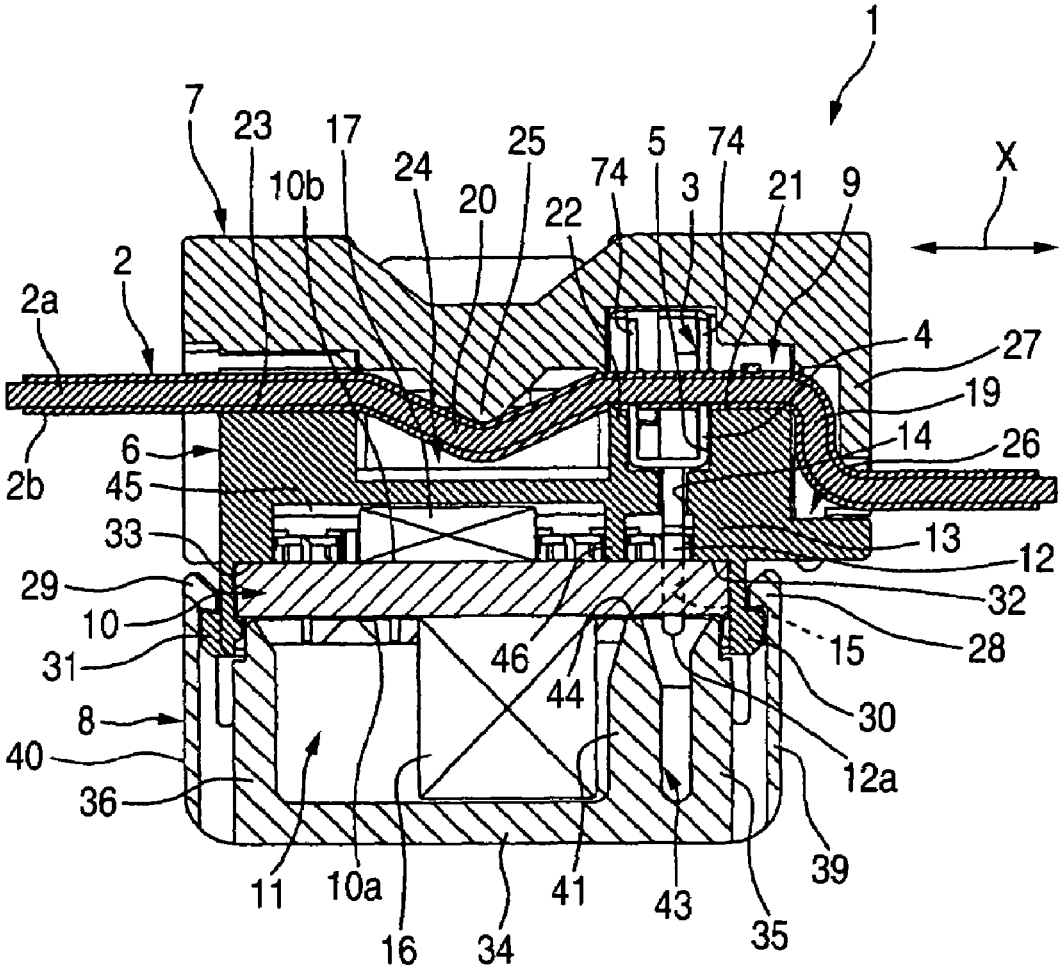
FIG. 3 is a sectional view taken along the line III—III in FIG. 2.

FIG. 1 is a schematic perspective view of a mode of embodiment of the insulation displacement connector with a built-in board according to the present invention, and FIG. 2 a plan view of the insulation displacement connector with a built-in board. FIG. 3 is a sectional view taken along the line III—III in FIG. 2, and FIG. 4 a sectional view taken along the line IV—IV in FIG. 2.

Referring to FIG. 1, FIG. 2 and FIG. 3, the insulation displacement connector with a built-in board 1 (which will hereinafter be referred to simply as "connector" as well) is provided with a plurality of insulation displacement terminals 3 (only one insulation displacement terminal is shown in FIG. 3) with which the intermediate portions of a plurality of insulated wires as feed wires extending in the first direction X are connected by insulation displacement, a main housing 6 having terminal retainer portions adapted to retain bodies 4 of the insulation displacement terminals 3 thereon, and first and second cover housings 7, 8 combined with the main housing 6 at the opposite sides (for example, upper and lower sides) thereof.

Figure 4:
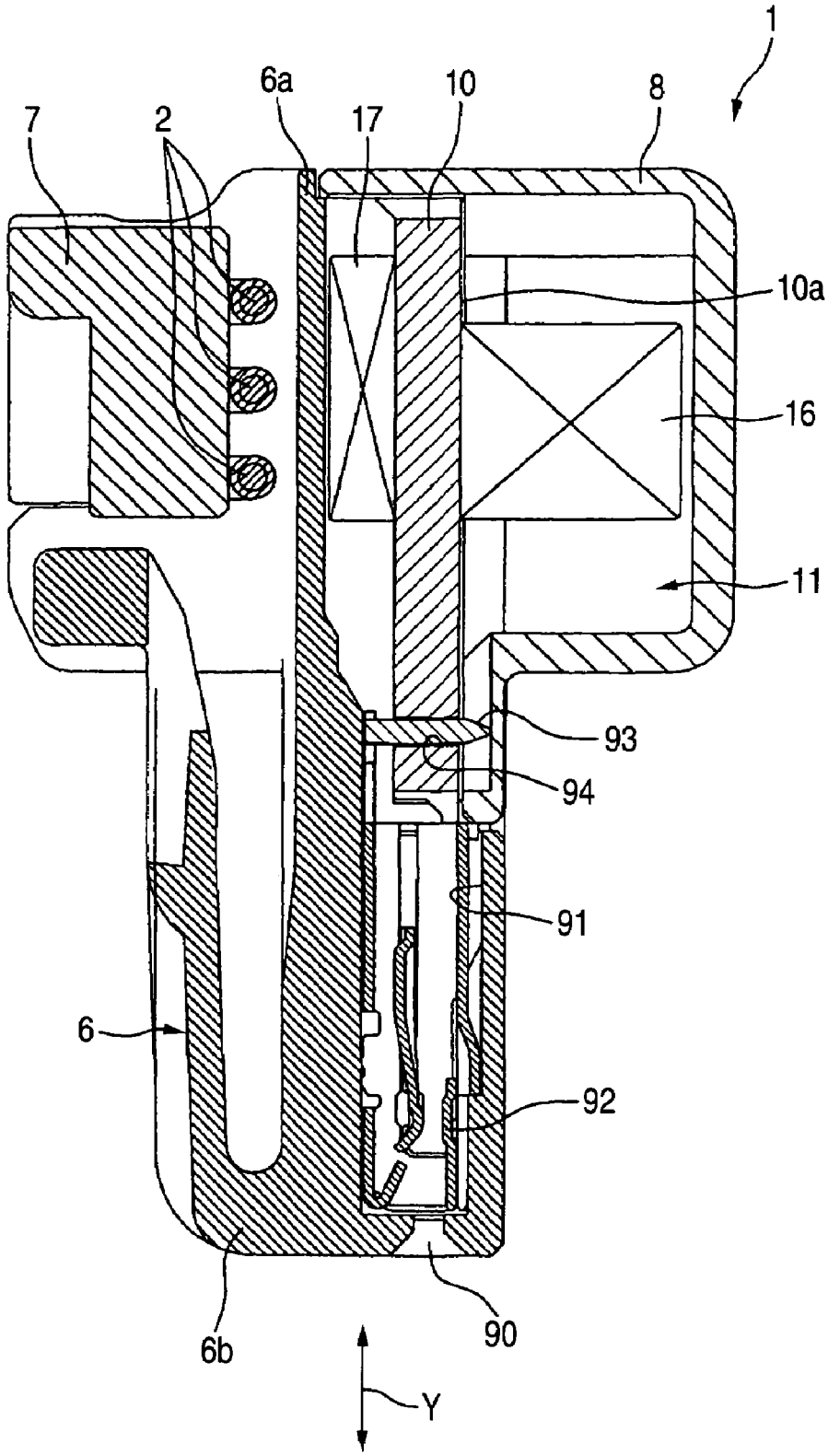
FIG. 4 is a sectional view taken along the line IV—IV in FIG. 2.

Referring to FIG. 1, the main housing 6 has a first portion 6*a* extending in a first direction X, and a second portion 6*b* extending in a second direction Y which crosses the first direction X at right angles thereto. The second portion 6*b* of the main housing 6 is provided at an end portion thereof with a plurality of openings 90 arranged laterally. As shown in FIG. 4, a female terminal 92 to which a corresponding male terminal pressure-engaged with an end portion of a wire (not shown) is connected is held and retained in a storage recess in an inner part of each opening 90. A lead 93 provided at one end of the female terminal 92 is inserted into a through hole 94 of a circuit board 10, and soldered to a conductive portion of a first surface 10*a* of the circuit board 10. Thus, the electrical connection of the lead to the circuit board 10 is attained.

Referring to FIG. 3, a first retaining space 9 for retaining required portions of the insulation displacement terminal 3 and insulated wire 2 is defined between the first portion 6*a* of the main housing 6 and the first cover housing 7 which are combined with each other. A second retaining space 11 for the circuit board 10 is defined between the main housing 6 and second cover housing 8 which are combined with each other.

A lead 12 extends from the body 4 of the insulation displacement terminal 3. This lead 12 is inserted through a through hole 14 of a bottom plate 13 of the main housing 6 into the second retaining space 11, and further inserted through a through hole 15 of the circuit board 10. The lead is then soldered at a lower end portion thereof to the first surface 10*a* of the circuit board 10.

Referring to FIG. 3 and FIG. 4, reference numerals 16, 17 denote elements, such as capacitors mounted on the first and second surfaces 10*a*, 10*b* of the circuit board 10.

Referring to FIG. 3, the insulated wire 2 passes through the first retaining space 9 so as to extend in the first direction X with the main housing 6 and first cover housing 7 in a combined state. In the first retaining space 9, an intermediate portion of the insulated wire 2 is connected by insulation displacement with an insulation displacement blade 74 of the body 4 of the insulation displacement terminal 3. The insulated wire 2 has first and second portions 19, 20 bent by projections opposed thereto of the first cover housing 7 at both sides between which the body 4 of the insulation displacement terminal 3 is held with respect to the first direction X. These bent portions 19, 20 prevent a drawing load exerted from the outside on the insulated wire 2 from being imparted to the insulated wire 2.

To be concrete, the main housing 6 has first, second and third wire retainer portions 21, 22, 23 of the same height arranged in the first direction X. The wire retainer portions 21, 22, 23 are formed like, for example, grooves, and plurally provided in accordance with the number of wires. The second and third wire retainer portions 22, 23 are disposed on the opposite side with respect to the first direction X of the first wire retainer portion 21 with the terminal retainer portion 5 held between the wire retainer portions 22, 23. The main housing 6 is provided with a recess 24 between the second and third wire retainer portions 22, 23, while the first cover housing is provided with a projection 25 opposed to the recess 24. The portion of the insulated wire 2 which extends between the second and third wire retainer portions 22, 23 is forced into the recess 24 by the projection 25, and bent thereby, the second bent portion 20 being formed in consequence.

The main housing 6 is provided with a recess 26 on the outer side of the first wire retainer portion 21 with respect to the first direction X, and an end wall 27 of the first cover housing 7 is provided so as to be opposed to the recess 26. The portion of the insulated wire 2 which extends from the first wire retainer portion 21 to the outside is forced into the interior of the recess 26 of the main housing 6 by the end wall 27 of the first cover housing 7 and bent in the shape of a crank. Thus, the first bent portion 19 as a portion bent in the shape of a crank is formed.

Figure 5:
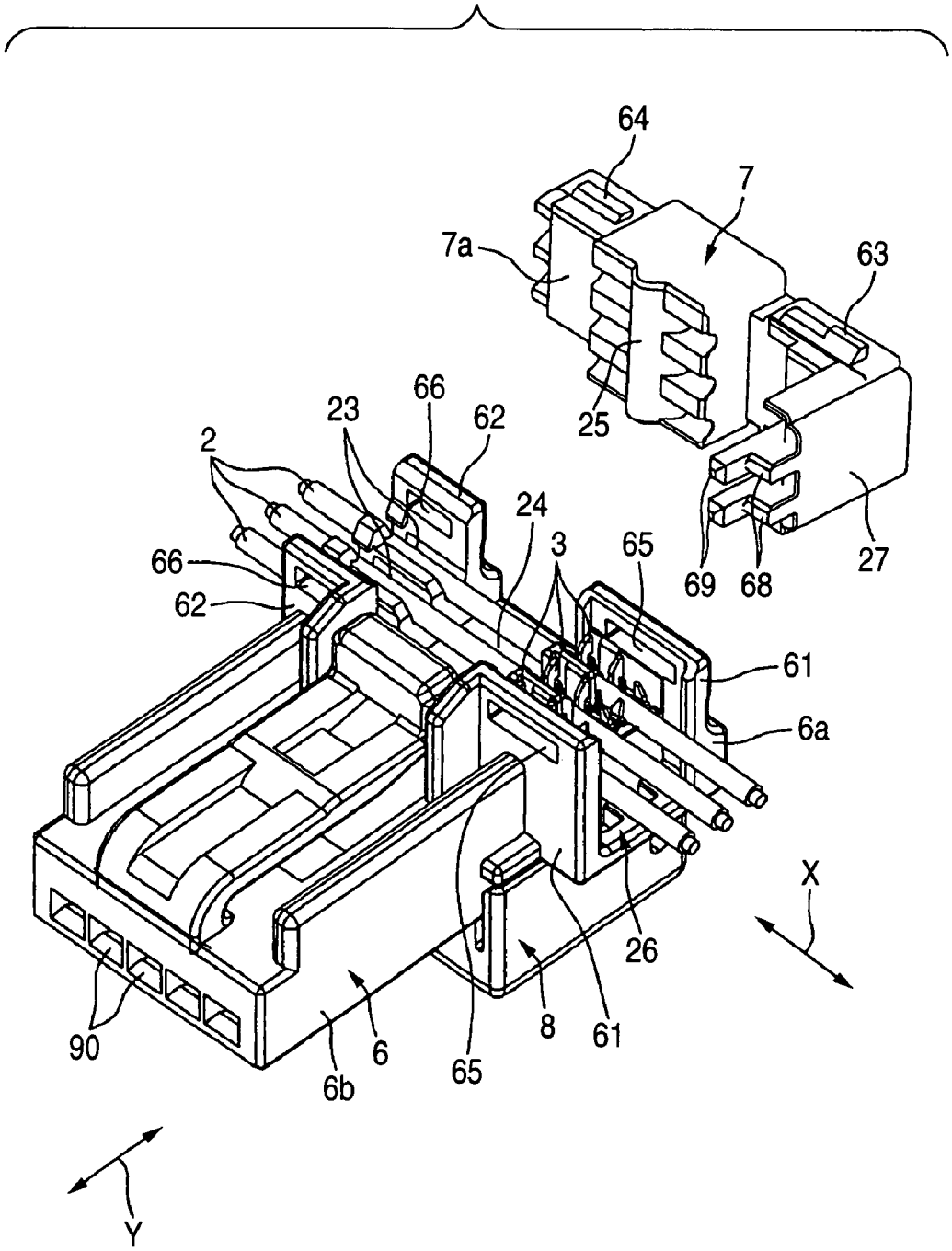
FIG. 5 is an exploded perspective view of the insulation displacement connector with a built-in board.

Referring to FIG. 5, an exploded perspective view, the first portion 6*a* of the main housing 6 is provided with a pair of walls 61, 62 extending at right angles to the second direction Y. The walls 61, 62 are provided with engagement portions 65, 66 made of, for example, locking recesses with which hooks 63, 64 opposed thereto of a side portion of the first cover housing 7 are engaged in a hung state.

The projection 25 provided on a lower surface 7*a* of the first cover housing 7 forces a part of the insulated wire 2 into the interior of the recess 24 with these hooks 63, 64 engaged in a hung state with the opposed engagement portions 65, 66. The end wall 27 of the first cover housing 7 is provided with, for example, a pair of first projections 67, and a pair of second projections 68 as, for example, a pair of connecting means the distance of projection of which is longer than that of projection of the first projections 67.

Figure 6:
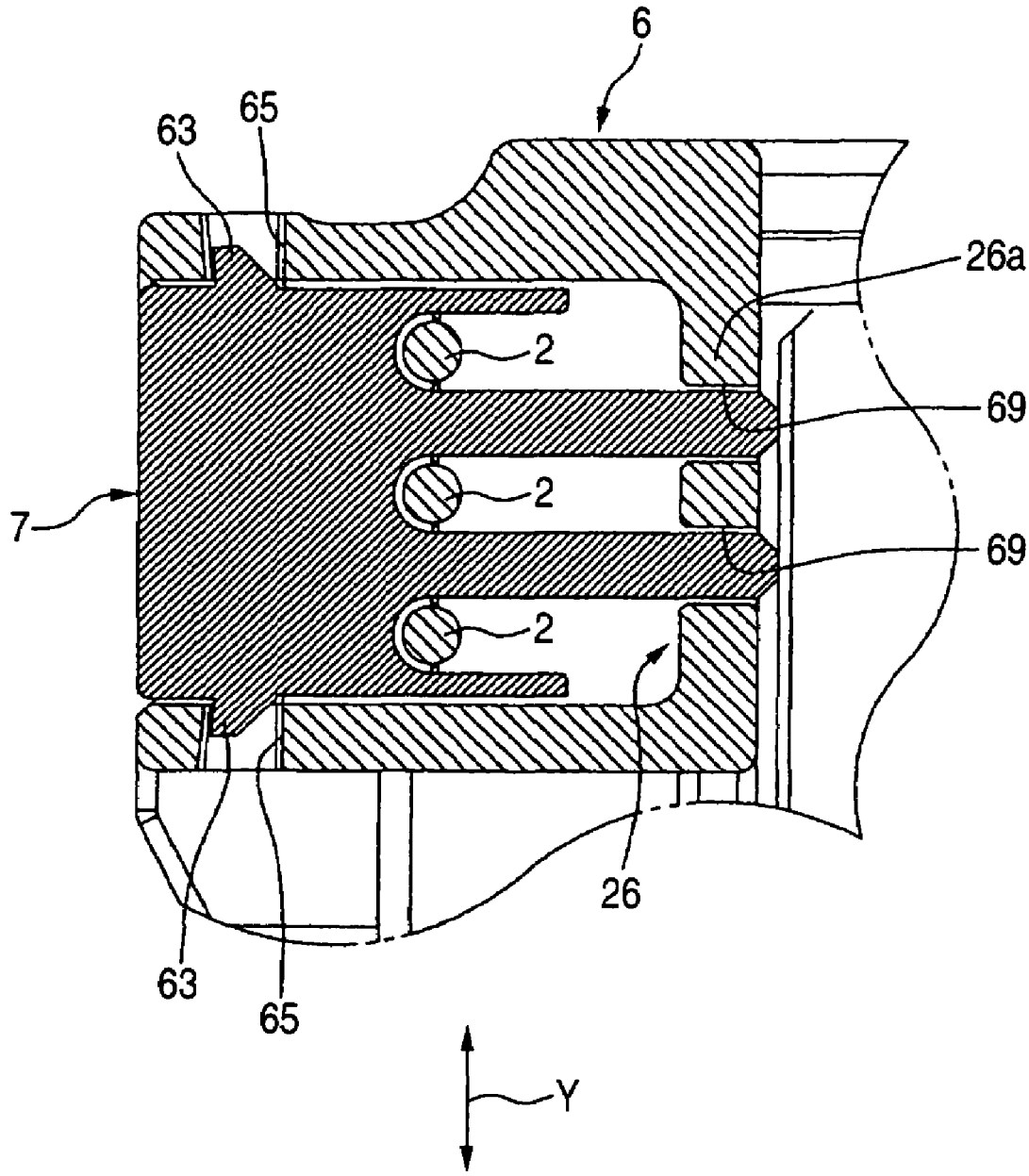
FIG. 6 is a sectional view taken along the line VI—VI in FIG. 2.

When the first cover housing 7 is combined with the main housing 6, the two first projections 67 are inserted between adjacent insulated wires 2, and engaged with a bottom wall 26*a* of the recess of the main housing 6, and the two second projections 68 are fitted in the engagement portions 69 made of engagement holes as a pair of opposed connecting means formed in the bottom wall 26*a* of the recess 26 of the main housing 6 as shown in FIG. 6, a sectional view taken along the line VI-VI in FIG. 2.

Since the end wall 27 of the first cover housing 7 is connected firmly to the main housing owing to the engaged parts, the connected parts are not disengaged from each other even when a drawing load should be imparted from the outside to the insulated wire. Namely, the so-called turn-up of the end wall 27 of the first cover housing 7 is prevented.

Referring to FIG. 3 again, both end portions with respect to the first direction X of the bottom plate 13 of the main housing 6 are provided with a pair of engagement portions 30, 31 projecting there from adapted to engage there with respectively in a hung state a pair of hooks 28, 29 of the second cover housing 8. The bottom plate 13 of the main housing 6 has a pair of contact portions 32, 33 adjacent to the engagement portions 30, 31, and the contact portions are engaged with a pair of end portions respectively of the second surface 10*b* of the circuit board 10.

Figure 7:
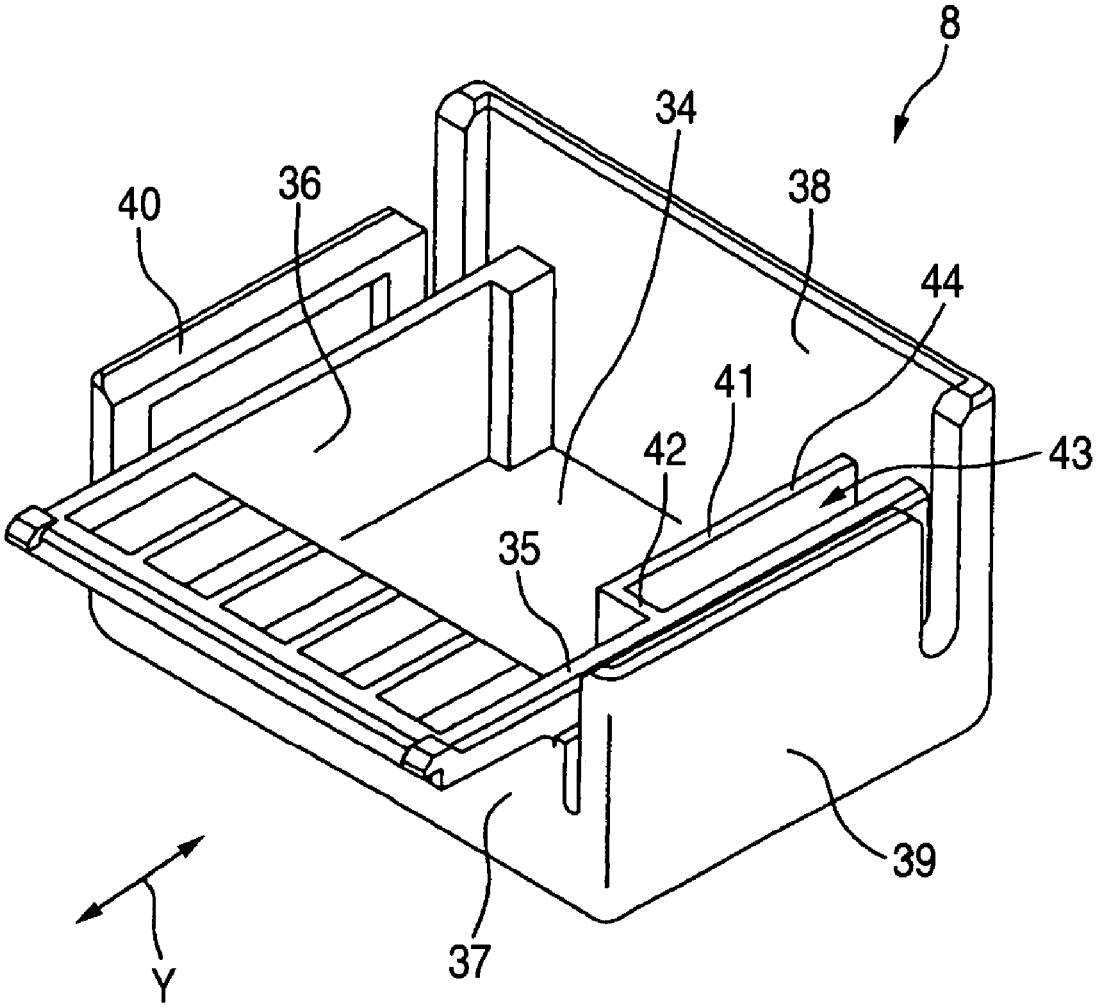
FIG. 7 is a perspective view of a second cover housing.

As shown in FIG. 7, the second cover housing 8 has a rectangular bottom wall 34, and first, second, third and fourth side walls 35, 36, 37, 38 surrounding the bottom wall 34. Reference numerals 39, 40 denote outer walls provided on the outer side of the first and second side walls 35, 36. The outer walls 39, 40 are provided at end portions thereof with hooks 28, 29 respectively as shown in FIG. 3.

Referring to FIG. 7, a rib 41 parallel to the first side wall 35 and a rib 42 parallel to the third side wall 37 are erected on the bottom plate 34. These ribs 41, 42 and the first side wall 35 and fourth side wall 38 form a box-like member 43 of a high strength. This box-like member 43 is provided with a receiving section 44 for receiving an insulation displacement load, which will be described later, via the circuit board 10. The receiving section 44 is formed by the first side wall 35 and end surfaces of the ribs 41, 42, and contacts the first surface 10*a* of the circuit board 10 as shown in FIG. 3. A lower end 12*a* of the lead 12 of the insulation displacement terminal 3 is inserted through the region of the circuit board 12 which is surrounded by the box-like portion 43.

Referring to FIG. 3, the end portions of the first and second side walls 35, 36 separated from each other in the first direction X hold between the same side walls and opposed contact portions 32, 33 of the main housing 6 the corresponding end portions of the circuit board 10.

The bottom plate 13 of the main housing 6 is provided with a recess 45 for holding circuit elements including the circuit element 17 mounted on the second surface 10*b* of the circuit board 10. In a part of this recess 45, a rib 46 contacting the second surface 10*b* of the circuit board 10 is stood up. This rib 46 is provided in a position substantially opposed to a rib 41 of the second cover housing 8 so that the circuit board 10 can be held between the two ribs 46, 41.

Figure 8:
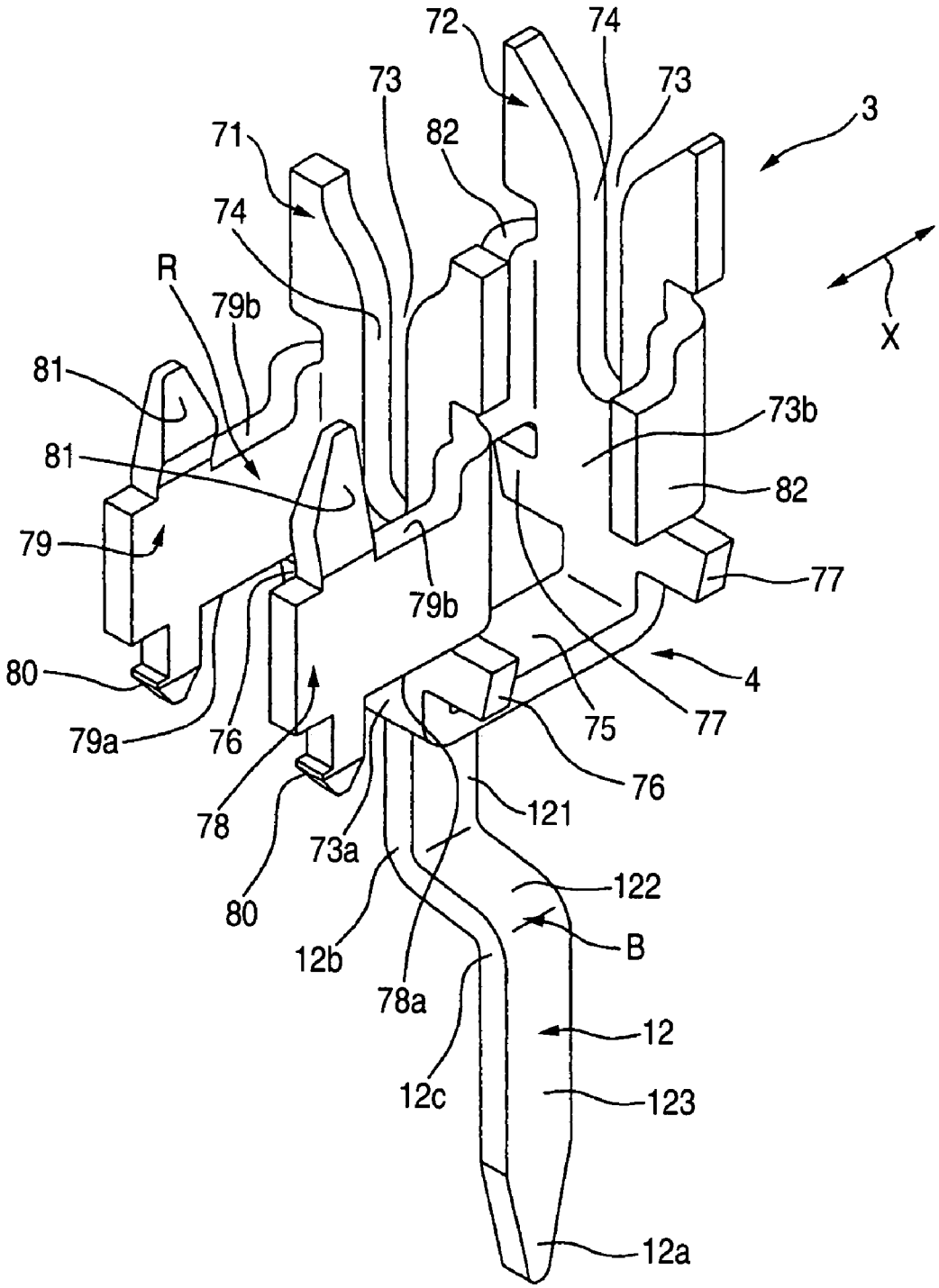
FIG. 8 is a perspective view of an insulation displacement terminal.

Referring then to FIG. 8, the terminal 3 is wholly molded by using a single sheet metal. The body 4 of the insulation displacement terminal 3 has first and second plate type insulation displacement groove-forming members 71, 72 opposed to each other in the first direction X. Each of the insulation displacement groove-forming members 71, 72 has, for example, a U-shaped insulation displacement blade 74 for defining a insulation displacement groove 73.

Figure 9:
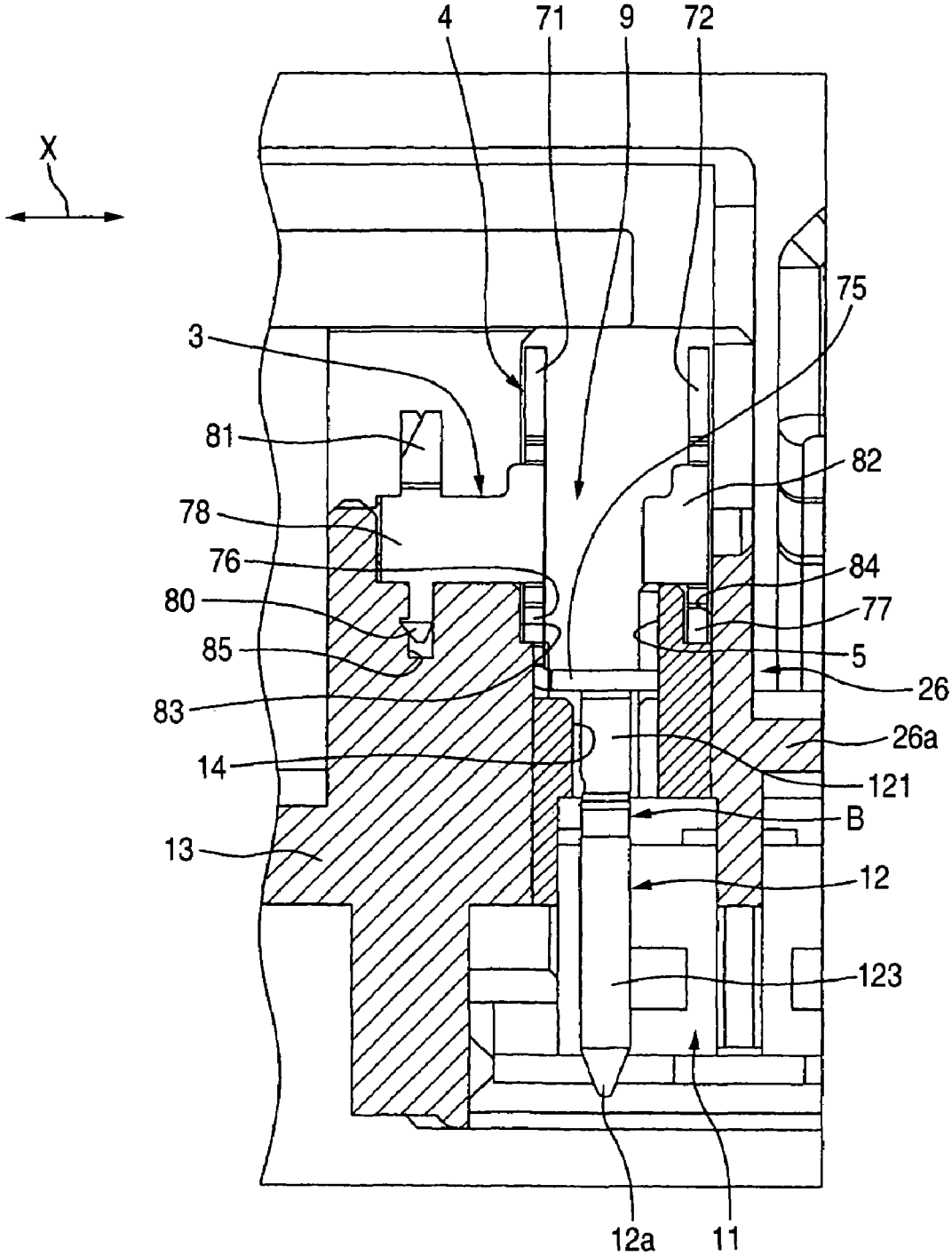
FIG. 9 is a schematic sectional view of the insulation displacement connector with a built-in board, showing the insulation displacement terminals held on terminal retainer portions of a main housing.

The bottom portions 73*a*, 73*b* of the first and second insulation displacement groove-forming members 71, 72 are joined together by a connecting portion 75. On both side edges of the bottom portions 73*a*, 73*b* of the first and second insulation displacement groove-forming members 71, 72, locking projections 76, 77 as locking portions adapted to be engaged with the terminal retainer portion 5 of the main housing 5*e* are formed so as to project sideways therefrom. As shown in FIG. 9, the locking projections 76, 77 are press fitted into and engaged with corresponding vertical grooves 83, 84 formed in the terminal retainer portion 5 of the main housing 6.

Referring again to FIG. 8, a pair of plate portions 78, 79 are formed in a bent state which extend from both side edges of the first insulation displacement groove forming member 71. These plate portions 78, 79 are provided so as to form a retaining space R therebetween for the insulated wire 2.

The lower edges 78*a*, 79*a* of the plate portions 78, 79 are formed so that these edges are received in an engaged state by the bottom section 5*a* of the terminal retainer portion 5. At each of the lower edges 78*a*, 79*a* of the plate portions 78, 79, a locking projection 80 as, for example, a hook-shaped locking projection adapted to be engaged with the terminal retainer portion 5 of the main housing 6 is formed in a downwardly projecting state. As shown in FIG. 9, each locking projection 80 is introduced into and engaged in a hung state with an engagement hole 85 formed in the terminal retainer portion 5 of the main housing 6.

Referring again to FIG. 8, a bendable member 81 formed on each of upper edges 78*b*, 79*b* of the plate portions 78, 79 so that the bendable member projects upward. These bendable members 81 are adapted to confine the insulated wire 2 in the retaining space by bending themselves inward toward each other. To be concrete, the retaining space R is defined by a corresponding portion 5*b* of the terminal retainer portion 5 of the main housing 6, two plate portions 78, 79 and the bent members 81.

The lead 12 is extended from one side edge of the connecting portion 75 in the downward direction, and includes at an intermediate section thereof a crank-shaped bent portion B as a deformable portion. To be concrete, the lead 12 has a first portion 121 extending from the connecting portion 75, bent at substantially right angles and then extending downward, a second portion 122 formed by bending the first portion 121 at a bend 12*b* at substantially right angles thereto and then extending substantially sideways, and a third portion 123 formed by bending the second portion 122 at a bend 12*c* at substantially right angles thereto and then extending downward. The bent portion B includes the second portion 122, two bends 12*b*, 12*c* and portions in the vicinity thereof.

Figure 10:
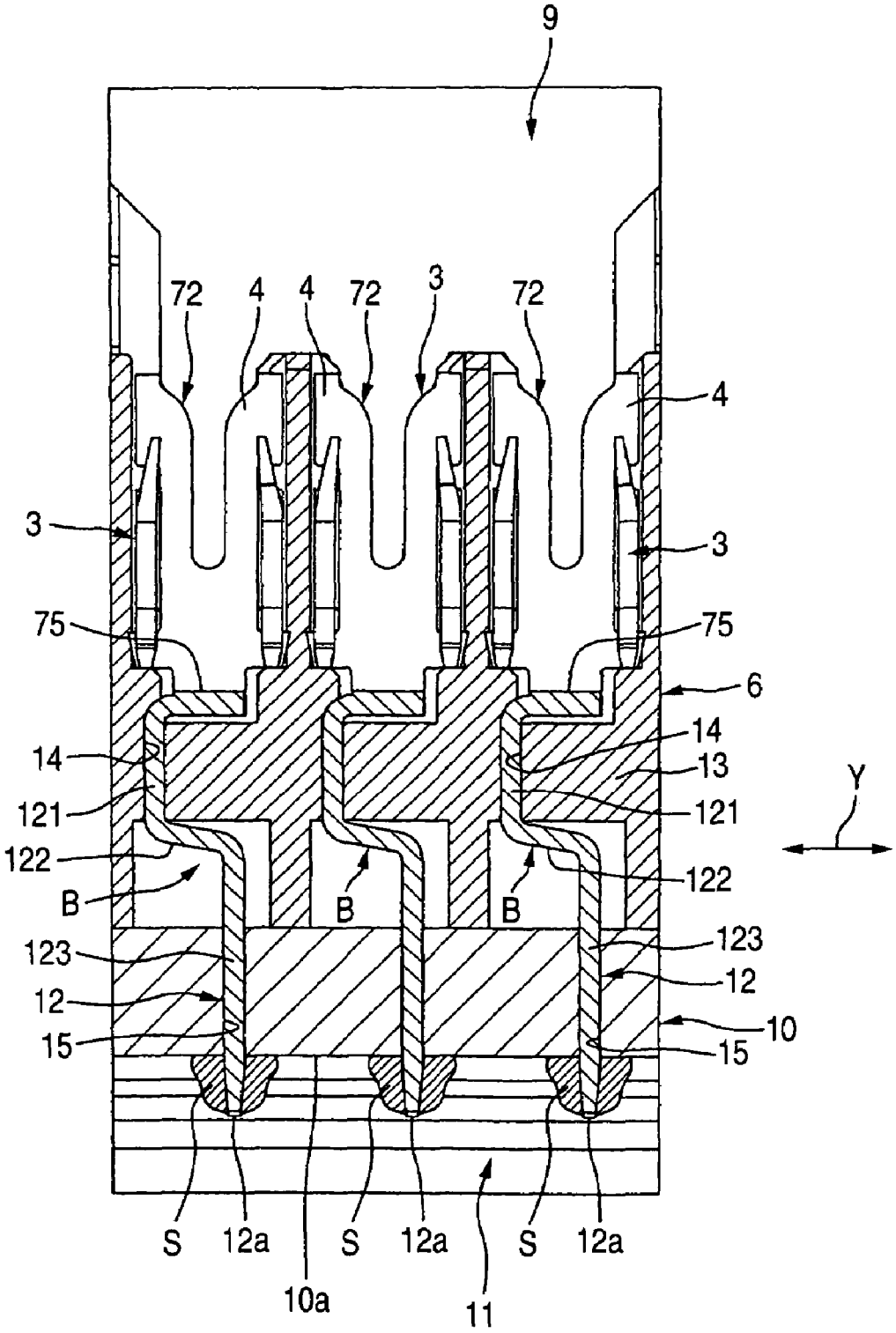
FIG. 10 is a schematic sectional view of a principal portion of the insulation displacement connector with a built-in board, showing that the leads of the insulation displacement terminals held on the terminal retainer portions of the main housing are soldered to a circuit board.

As shown in FIG. 10, the first portion 121 is inserted through an insert hole 14 of the main housing 6, and the third portion 123 through a through hole 15 of the circuit board 10. The bent portion B is positioned between the bottom plate 13 of the main housing 6 and the circuit board 10. The bent portion B is deformed when the insulation displacement terminal is connected by insulation displacement with the wire, so that the imparting of an insulation displacement load to a soldered portion S at a lower end 12*a* of the lead 12 can be prevented.

Figure 11:
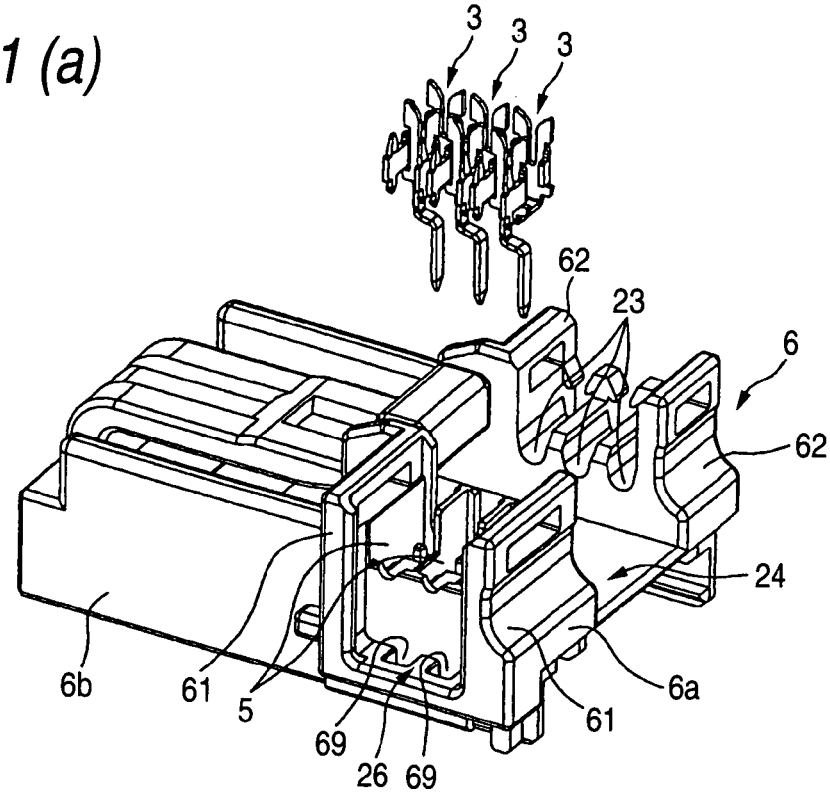
FIG. 11(*a*) and FIG. 11(*b*) are perspective views showing the steps of combining insulation displacement terminals with the main housing.
Figure 11:
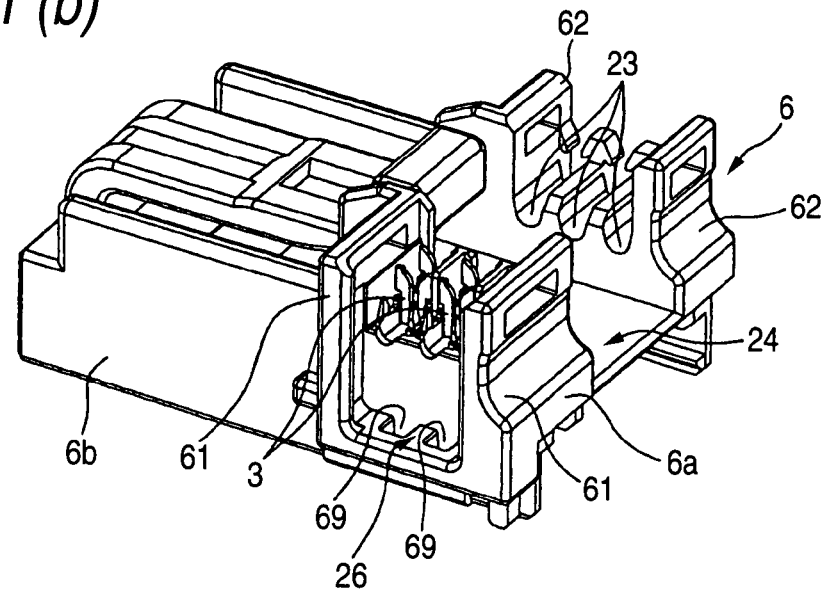

In order to assemble the insulation displacement connector with a built-in board 1 in this mode of embodiment, each insulation displacement terminal 3 is combined with the main housing 6 first as shown in FIG. 11(*a*) and FIG. 11(*b*). The body 4 of the insulation displacement terminal 3 is fixed to the terminal retainer portion 5 of the main housing 6 by using the locking projections 76, 77, 80 as shown in FIG. 9, and the lead 12 of the insulation displacement terminal 3 is inserted into the through hole 14 of the bottom plate 13 of the main housing, the lead 12 being then extended into the second retaining space 11.

The circuit board 10 on which the circuit elements are mounted in advance is then held in the second retaining space, and the lead 12 is inserted through the through hole 15 of the circuit board 10 as shown in FIG. 10. The lower end 12*a* of the lead 12 is thereafter soldered.

The second cover housing 8 is then combined with the main housing 6, and the circuit board 10 is held in the second retaining space 11 to form a subassembly. The insulation displacement terminals 3 are connected by insulation displacement with a desired portion of the insulated wire 2 as, for example, a feed wire with the insulation displacement connector in the state of such a subassembly. After the insulation displacement connector subassembly is connected by insulation displacement with the insulated wire 2, the first covering housing 7 is combined with the main housing 6 to complete the assembling of the insulation displacement connector with a built-in board 1.

As shown in FIG. 3, when the first covering housing 7 is combined with the main housing 6, the end wall 27 of the first cover housing 7 forces the corresponding portion of the insulated wire 2 into the recess 26 of the main housing 6, the insulated wire 2 being thereby bent in the shape of a crank to provide the first bent portion 19. In the meantime, the projection 25 of the first cover housing 7 forces the corresponding portion of the insulated wire 2 into the recess 24 of the main housing 6, the insulated wire 2 being thereby bent to provide the second bent portion 20.

Therefore, the first and second bent portions 19, 20 are provided on both sides of the insulation displacement terminal 3, i.e., at the portions of the insulated wire between which the insulation displacement terminal 3 is provided. As a result, even when the insulated wire 2 receives a drawing load from the outside of the insulation displacement connector with a built-in board 1, the drawing load is not imparted to the insulation displacement connecting portion of the insulation displacement terminal, so that the reliability of the electrical connection of the connector can be greatly heightened.

Especially, since the first bent portion 19 is in the shape of a crank, the imparting of the drawing load to the insulation displacement connecting portion can be reliably prevented.

Moreover, since the cover housing 7 and main housing 6 are connected together by fitting the second projections 67 of the end wall 27 of the first cover housing 7 in the engagement holes 69 of the recess 26 of the main housing 6, the floating of the end wall 27 of the first cover housing 7 up from the main housing 6 and the imparting of the drawing load to the insulation displacement connecting portion can be prevented more reliably. Especially, since the second projections 68 are engaged with corresponding engagement holes 69 through the insulated wires 2, the floating of the end wall 27 up from the first cover housing 7 can be prevented more reliably.

In the condition of a subassembly in which all the parts except the first cover housing 7 are combined together, a so-called desired portion of the insulated wire can be connected by insulation displacement with the insulation displacement terminals, i.e., the degree of freedom of selecting the portion of the insulated wire to be connected by insulation displacement with the insulation displacement terminal is high. This insulation displacement connector with a built-in board can be suitably used for a wire in LAN (Local Area Network) between various kinds of ECU's in a vehicle, especially, an automobile.

Especially, since the receiving section 44 of the second cover housing 8 can receive the insulation displacement load via the bottom plate 13 of the main housing 6 and the circuit board 10, the bottom plate 13 and circuit board 10 are not inadvertently bent, so that a reliable insulation displacement connecting operation can be attained. This has substantially enabled a so-called in-housing insulation displacement connecting operation by the insulation displacement connector with a built-in board to be carried out.

The receiving section 44 adapted to receive a load occurring when the above-described insulation displacement connecting operation is carried out is provided in the box-like member 43 of a high strength of the second cover housing 8 as shown in FIG. 7, the receiving section receives the insulation displacement load securely, so that a reliable insulation displacement connecting operation can be attained.

As shown in FIG. 3, the circuit board 10 is held between the bottom plate 10 of the main housing 6 and the rib 41 of the second cover housing 8, so that the inadvertent bending of the circuit board 10 due to the insulation displacement load can be reliably prevented.

Even when the load should be imparted to the lead 12 while the connector is connected by insulation displacement with the insulated wire, the crank-shaped bent portion B of the lead 12 is plastically deformed as shown in FIG. 10. Therefore, such a load can be absorbed in this bent portion B. As a result, an unnecessary load is not imparted to the relative soldered portion S. The load occurring when the connector is connected by insulation displacement with the insulated wires can be absorbed reliably owing to the simple structure provided on the lead 12.

Figure 12:
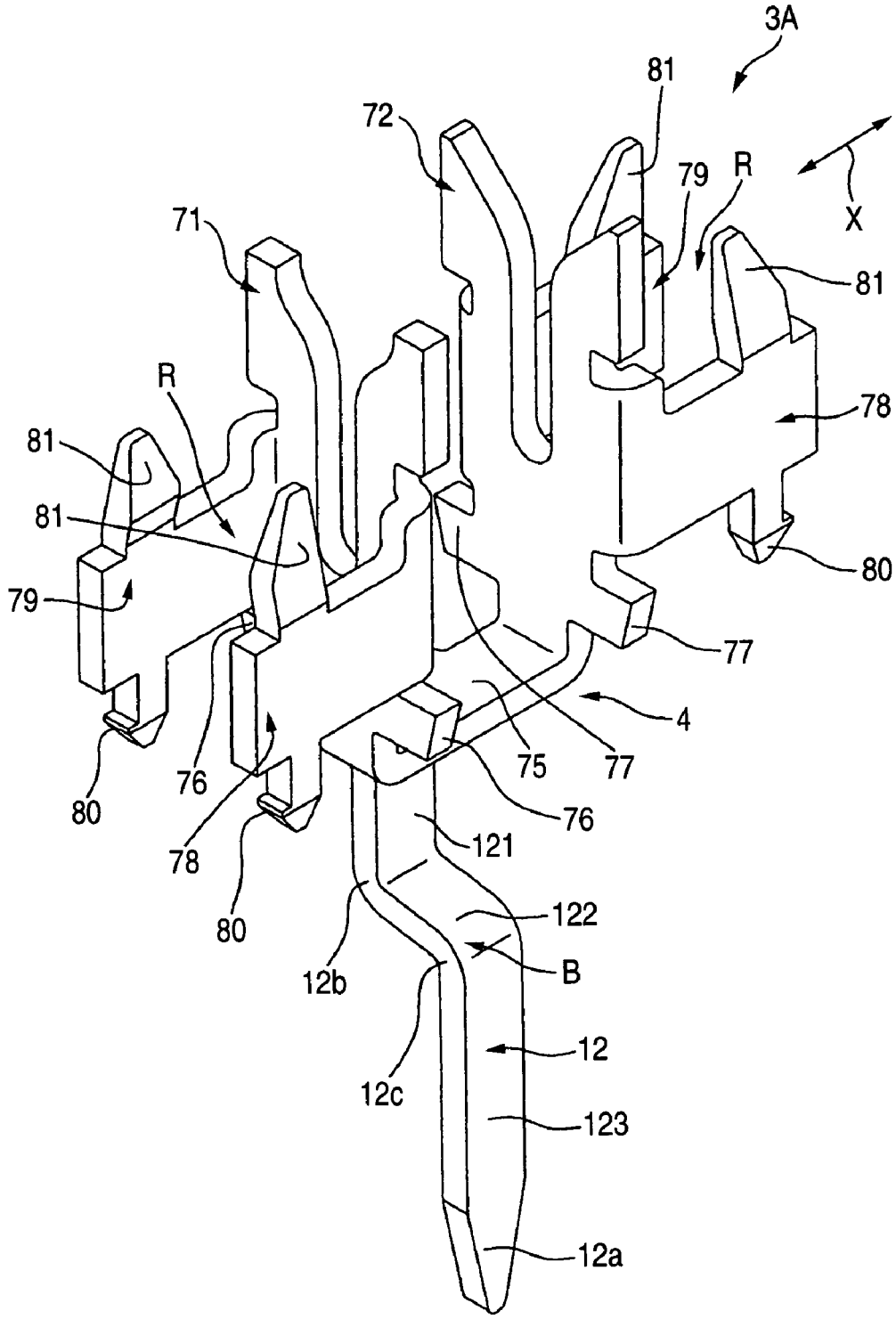
FIG. 12 is a perspective view showing a modified example of the insulation displacement terminal.

In the insulation displacement terminals 3 in the mode of embodiment of FIG. 8, the plate portions 78, 79 are extended only from the first insulation displacement groove-forming member 71 but the part from which the plate portions are extended is not limited to the member 71. The plate portions 78, 79 for defining the retaining space R can also be extended in a bent state from the second insulation displacement groove-forming member 72 as shown in FIG. 12. In this case, the insulated wires 2 can be retained more reliably.

The present invention is not limited to the above-described mode of embodiment. For example, in the structure for providing the first bent portion 19, it is also possible to provide the second projection 67 on the main housing 6, and the engagement holes 69 in the first cover housing 7. Moreover, it is also conceivable that the second bent portion 20 be abolished. Besides these, various modifications can be made in the claims of the present invention.

INDUSTRIAL APPLICABILITY

According to the present invention, an insulation displacement connector with a built-in board is provided which does not encounter even when a drawing load is imparted from the outside to the insulated wires the loosening of the insulation displacement connecting portions of the connector and insulated wires, and the receiving of the influence of the drawing load at the soldered portions of the insulation displacement terminals and circuit board. In the connector with built-in circuit board, the insulation displacement connecting of the insulation displacement terminals soldered to the circuit board with insulated wires within the housing can substantially be carried out.

What is claimed is:

1. An insulation displacement connector with a built-in board, comprising:

an insulation displacement terminal including:

a body having an insulation displacement blade connectable with an insulated wire at an intermediate portion of the insulated wire by insulation displacement; and a lead extending from the body;

a main housing including:

a bottom plate having a hole through which the lead is inserted; and a terminal retainer portion formed on the bottom plate for retaining the body of the insulation displacement terminal;

a circuit board, wherein the lead inserted through the hole of the bottom plate of the main housing is soldered to the circuit board;

a first cover housing attached to the main housing, wherein a first retaining space for the insulation displacement terminal is defined between the main housing and the first cover housing; and a second cover housing attached to the main housing, wherein a second retaining space for the circuit board is defined between the main housing and the second cover housing, wherein the insulated wire has a pair of bent portions, formed by the first covering housing, at both sides of the body of the insulation displacement terminal.

2. The insulation displacement connector with a built-in board according to claim 1, wherein the pair of bent portions of the insulated wires include a crank-like bent portion formed by opposed portions of the main housing and first cover housing.

3. The insulation displacement connector with a built-in board according to claim 1, wherein the opposed portions of the main housing and first cover housing include an end wall of the first cover housing, further comprising a means for connecting the end wall to the portion of the main housing which corresponds thereto.

4. The insulation displacement connector with a built-in board according to claim 3, wherein the insulated wires are plural parallel-extending insulated wires, and wherein the connecting means includes:

a projection which are provided on either one of the main housing and first cover housing, and which extends between the adjacent insulated wires; and a recess provided in the other of the main housing and first cover housing and engaged with the corresponding projection.

5. An insulation displacement connector with a built-in board, comprising:

an insulation displacement terminal including:

a body having an insulation displacement blade connectable with an insulated wire at an intermediate portion of the insulated wire by insulation displacement; and a lead extending from the body;

a main housing including:

a bottom plate having a hole through which the lead is inserted; and a terminal retainer portion formed on the bottom plate for retaining the body of the insulation displacement terminal;

a circuit board, wherein the lead inserted through the hole of the bottom plate of the main housing is soldered to the circuit board;

a first cover housing attached to the main housing, wherein a first retaining space for the insulation displacement terminal is defined between the main housing and the first cover housing;

a second cover housing attached to the main housing, wherein a second retaining space for the circuit board is defined between the main housing and the second cover housing; and a projection and an end wall provided on the first cover housing and adapted to bend the insulated wire at both side portions of the body of the insulation displacement terminal.

6. The insulation displacement connector with a built-in board according to claim 5, wherein the main housing has a wire retainer portion on one side of the body of the insulation displacement terminal, and a recess on further outer side of the wire retainer portion, and wherein the insulated wire is bent in the crank-like shape by the wire retainer portion on one side of the body of the insulation displacement terminal, the recess of the main housing, and the projection of the first cover housing.

7. An insulation displacement connector with a built-in board, comprising:

an insulation displacement terminal including:

a body having an insulation displacement blade connectable with an insulated wire at an intermediate portion of the insulated wire by insulation displacement; and a lead extending from the body;

a main housing including:

a bottom plate having a hole through which the lead is inserted; and a terminal retainer portion formed on the bottom plate for retaining the body of the insulation displacement terminal;

a circuit board, wherein the lead inserted through the hole of the bottom plate of the main housing is soldered to the circuit board;

a first cover housing attached to the main housing, wherein a first retaining space for the insulation displacement terminal is defined between the main housing and the first cover housing; and a second cover housing attached to the main housing, wherein a second retaining space for the circuit board is defined between the main housing and the second cover housing, wherein the second cover housing has a portion for receiving an insulation displacement load of the insulation displacement terminal via the bottom plate and circuit board, wherein the portion is formed on a position opposed to the terminal retainer portion of the main housing.

8. The insulation displacement connector with a built-in board according to claim 7, wherein the second cover housing includes a rib, and a box-like member wherein at least a part of the box-like member is formed by the rib, and wherein the receiving portion is provided in the box-like portion.

9. The insulation displacement connector with a built-in board according to claim 8, wherein the bottom plate of the main housing includes a rib capable of holding the circuit board between the second cover housing and the rib of the second cover housing.

10. The insulation displacement connector with a built-in board according to claim 7, wherein the lead includes a deformable portion capable of being elastically deformed by the insulation displacement load.

11. The insulation displacement connector with a built-in board according to claim 10, wherein the deformable portion includes a portion bent in the crank-like shape.

* * * * *